US008025161B2

(12) United States Patent
Chookang

(10) Patent No.: US 8,025,161 B2
(45) Date of Patent: Sep. 27, 2011

(54) LAMINATED GLASS RACK, AND/OR METHOD OF MAKING AND/OR SHIPPING LAMINATED GLASS PANELS USING THE SAME

(75) Inventor: Larry Chookang, Scarborough (CA)

(73) Assignee: Guardian Industries Corp., Auburn Hills, MI (US)

( * ) Notice: Subject to any disclaimer, the term of this patent is extended or adjusted under 35 U.S.C. 154(b) by 418 days.

(21) Appl. No.: 12/078,803

(22) Filed: Apr. 4, 2008

(65) Prior Publication Data

US 2009/0250416 A1 Oct. 8, 2009

(51) Int. Cl.
*A47G 19/08* (2006.01)

(52) U.S. Cl. ..... 211/41.14; 211/13.1; 280/79.11; 206/454; 206/451

(58) Field of Classification Search ..... 211/41.14, 211/13.1, 60.1, 189, 49.1, 50, 41.1, 47, 10, 211/41.12, 40; 206/451, 454, 449, 448; 280/79.11, 280/79.3, 47.35, 33.998
See application file for complete search history.

(56) References Cited

U.S. PATENT DOCUMENTS

| | | | | | |
|---|---|---|---|---|---|
| 45,648 | A * | 12/1864 | Smith | 211/41.13 |
| 1,662,730 | A * | 3/1928 | Wertenberger et al. | 280/47.2 |
| 3,349,924 | A * | 10/1967 | Maurer et al. | 211/41.1 |
| 3,781,003 | A * | 12/1973 | DeAngelis | 269/40 |
| D370,330 | S * | 5/1996 | Carpenter et al. | D34/21 |
| 6,102,206 | A * | 8/2000 | Pride | 206/454 |
| 6,492,454 | B1 * | 12/2002 | Ozawa et al. | 524/493 |
| 6,588,605 | B1 * | 7/2003 | Volkert et al. | 211/41.14 |
| 6,705,466 | B2 * | 3/2004 | Bartholomew et al. | 206/454 |
| 6,820,752 | B2 | 11/2004 | Jeskey et al. | |
| 6,962,476 | B2 * | 11/2005 | Trpkovski | 414/745.1 |
| 2003/0141213 | A1 * | 7/2003 | Bartholomew et al. | 206/454 |
| 2003/0196973 | A1 * | 10/2003 | Jacobs | 211/85.7 |
| 2004/0200788 | A1 * | 10/2004 | Shon et al. | 211/41.18 |
| 2004/0238465 | A1 * | 12/2004 | Mercure | 211/41.14 |
| 2004/0245195 | A1 * | 12/2004 | Pride | 211/41.14 |
| 2005/0067360 | A1 * | 3/2005 | Darvial | 211/41.14 |
| 2005/0098954 | A1 * | 5/2005 | Stutz | 273/390 |
| 2006/0043032 | A1 * | 3/2006 | McHugh | 211/41.14 |
| 2006/0182567 | A1 | 8/2006 | Roestel | |
| 2006/0192210 | A1 * | 8/2006 | Miyazawa | 257/79 |
| 2006/0196838 | A1 * | 9/2006 | Mercure et al. | 211/41.1 |
| 2006/0213846 | A1 | 9/2006 | Edwards et al. | |
| 2007/0187916 | A1 * | 8/2007 | Gregory et al. | 280/79.3 |
| 2007/0221592 | A1 * | 9/2007 | Strauss et al. | 211/41.15 |
| 2009/0004348 | A1 * | 1/2009 | Silva | 426/315 |

* cited by examiner

*Primary Examiner* — Darnell Jayne
*Assistant Examiner* — Devin Barnett
(74) *Attorney, Agent, or Firm* — Nixon & Vanderhye P.C.

(57) ABSTRACT

Certain example embodiments relate to glass racks that are suitable for both autoclaving and shipping. In certain example embodiments, a glass rack may include a metal base having a grooved bottom connected thereto and a metal upright support substantially parallel to the base. The upright support may include a plurality of fingers covered in a protective material (e.g., rubber tubing) that extend therefrom. The spaces between the fingers may correspond with grooves of the grooved bottom, thereby cooperating to accommodate a plurality of panels (e.g., assemblies prior to autoclaving, laminated glass panels formed by autoclaving, etc.). The grooved bottom may be connected to the base so as to allow for expansion and/or contraction of the metal base relative to the grooved bottom. The rack, as a whole, may be capable of withstanding the temperature and pressure conditions of an autoclave, while also providing sufficient protection for the panels during shipping.

13 Claims, 15 Drawing Sheets

LAMINATED GLASS RACK, AND/OR METHOD OF MAKING AND/OR SHIPPING LAMINATED GLASS PANELS USING THE SAME

FIELD OF THE INVENTION

Certain example embodiments of this invention relate to glass racks. More particularly, certain example embodiments relate to glass racks that are suitable for both autoclaving and shipping. In certain example embodiments, a glass rack may comprise a metal base having a grooved bottom connected thereto and a metal upright support substantially parallel to the base. The upright support may include a plurality of long, spaced apart fingers that extend therefrom, the fingers being covered in a protective material such as rubber tubing. The spaces between the fingers may correspond with the grooves formed in the grooved bottom of the base so as to accommodate a plurality of panels (e.g., glass assemblies prior to autoclaving, laminated glass panels formed by autoclaving, etc.). The grooved bottom base may be connected to the base so as to allow for expansion and/or contraction of the metal base relative to the grooved bottom. The rack, as a whole, may be capable of withstanding the harsh temperature and pressure conditions of the autoclave, while also providing sufficient protection for the panels during shipping.

BACKGROUND AND SUMMARY OF EXAMPLE EMBODIMENTS OF THE INVENTION

Numerous glass applications involve autoclaving and autoclave devices. For example, an autoclave may be used to create laminated glass. Laminated glass is used in safety glass applications such as, for example, vehicle window, hurricane glass, blast-resistant glass, and other applications.

As is known, to make laminated glass, first and second glass substrates are arranged so as to sandwich a polymer-inclusive interlayer (which may be polyvinyl butyral (PVB), ethylvinyl acetate (EVA), and/or the like). The sandwich is heated, typically to a temperature of about 120-170° F., and then roller pressed to remove air trapped between the interlayer and to initiate adhesion of the interlayer to the glass. In an autoclaving process, the rolled sandwich is exposed to an elevated temperature, typically about 275°-300° F., and an elevated atmospheric pressure typically about 150-190 psig, until interlayer adheres to the glass and air trapped within the interlayer is removed. The autoclave operation may take two hours to four hours per treatment. When impacted by an object, laminated glass tends to retain its overall structural integrity and thus reduces the occurrence of flying glass resulting from glass breakage.

Many conventional autoclaving processes work in batch. To this end, the rolled glass sandwiches to be autoclaved are often placed on autoclavable racks (e.g., racks that can withstand the harsh conditions of the autoclaving process). The racks are positioned within the autoclave. After the autoclaving process has completed, the autoclavable racks are removed from the autoclave. In typical process flows, the now-laminated glass panels are moved from the autoclavable racks to other racks for transportation to a shipping or warehousing site. Once at the shipping or warehousing site, the laminated glass panels sometimes are again moved to still other shippable or storable racks. In fact, it has been observed that conventional techniques require the triple and quadruple handing and repacking of the laminated glass panels once they are off of the lamination line.

Although this typical process flow has worked, further improvements are still possible. For example, as will be appreciated from the above description, current process flows require a large amount of handling and packing, e.g., to move and remove, and pack and repack, the intermediate and final laminated glass products from rack-to-rack and from place-to-place. Unfortunately, this increases the time and costs associated with laminated glass panels. The increased handling and repacking also unfortunately results in the loss of glass. This waste increases costs yet further, creates potential safety hazards, and requires additional work to create replacement panels.

Thus, it will be appreciated that it would be advantageous to develop a single rack design on which laminated glass panels could be autoclaved and shipped.

Currently, the same racks cannot be used for autoclaving and shipping. The autoclavable racks can withstand the harsh temperature and pressure conditions of the autoclave, but they fail to provide the physical protection for the laminated glass panels needed for shipping. Conversely, the shippable racks typically provide more physical protection for the laminated glass panels than do the autoclavable racks, but they cannot withstand the harsh temperature and pressure conditions of the autoclave. Although attempts have been made to develop racks that can accommodate both autoclaving and shipping, it is believed that no current racks have been developed that are both autoclavable and shippable.

Certain example embodiments of this invention reduce these and/or other problems associated with conventional processing flows and conventional glass racks. More particularly, one illustrative aspect of certain example embodiments of this invention relates to an autoclavable and shippable glass rack. The glass racks of certain example embodiments advantageously reduce the handling and packing requirements of conventional techniques, thereby reducing production time and costs, while also reducing the amount of waste created.

In certain example embodiments of this invention, an apparatus is provided. A base is provided to the apparatus. An upright support is substantially perpendicular to the base. At least one brace connects the base to the upright support. At least one support bar is provided to the upright support. A grooved bottom is connected to the base. A plurality of spaced-apart finger bars protrude from the at least one support bar so that spaces between adjacent finger bars correspond with grooves formed in the grooved bottom. Each finger bar is at least partially covered in a protective material. The base, the upright support, the at least one support bar, and the plurality of finger bars are metal inclusive and capable of withstanding exposure to autoclaving temperature and pressure conditions. The grooved bottom and the protective material covering the finger bars are capable of withstanding exposure to autoclaving temperature and pressure conditions. The grooved bottom is connected to the base so as to accommodate at least some expansion and/or contraction of the base relative to the grooved bottom. The grooves and the spaces between adjacent finger bars are arranged to accommodate glass panels and/or glass assemblies during autoclaving and/or shipping.

In certain example embodiments, an autoclavable and shippable glass rack is provided. a substantially square pallet base is provided to the rack. A substantially rectangular upright support comprises first and second substantially vertical posts, a plurality of support bars connecting the first and second posts, and an uppermost bar connecting the first and second posts. The upright support is substantially perpendicular to the base. First and second braces connect the base to the upright support. A grooved bottom is connected to the base. A plurality of spaced-apart finger bars protrude from each said support bar of the upright support so that spaces between adjacent finger bars on each said support bar correspond with grooves formed in the grooved bottom. Each said finger bar is at least partially covered in a heat-resistant protective rubber. The base, the upright support, each said support bar, and the plurality of finger bars include steel and are capable of withstanding exposure to autoclaving temperature and pressure conditions. The grooved bottom and the protective rubber covering the finger bars are capable of withstanding exposure to autoclaving temperature and pressure conditions. The grooved bottom is connected to the base so as to accommodate at least some expansion and/or contraction of the base relative to the grooved bottom. The grooves in the grooved bottom and the spaces between adjacent finger bars cooperate to accommodate glass panels and/or glass assemblies during autoclaving and/or shipping. The autoclaving conditions include exposure to a temperature of about 300° F. for a period of about 2.5 hours.

In certain example embodiments, a method of making one or more laminated glass panels is provided. A rack is provided, with the rack comprising: a substantially square metal pallet base and a substantially rectangular metal upright support comprising first and second substantially vertical posts, a plurality of support bars connecting the first and second posts, and an uppermost bar connecting the first and second posts, the upright support being substantially perpendicular to the base; first and second braces connecting the base to the upright support; a grooved bottom connected to the base so as to accommodate at least some expansion and/or contraction of the base relative to the grooved bottom; and a plurality of spaced-apart finger bars protruding from each said support bar of the upright support so that spaces between adjacent finger bars on each said support bar correspond with grooves formed in the grooved bottom, each said finger bar being at least partially covered in a heat-resistant protective rubber. At least one sandwich is created. Each said sandwich corresponds to one said laminated glass panels to be made. Each said sandwich comprises first and second glass panels surrounding a polymer-inclusive laminating layer. Each said sandwich is loaded into the rack such that each sandwich slides along a groove and in between corresponding adjacent finger bars. The rack including the at least one sandwich is autoclaved in making the one or more laminated glass panels. The rack and each component thereof is capable of withstanding temperature and pressure conditions associated with the autoclaving while supporting the sandwiches and/or laminated glass panels.

In certain example embodiments, an apparatus is provided. The apparatus includes a pallet base. An upright support comprises first and second substantially vertical posts. A plurality of support bars connect the first and second posts, and an uppermost bar connects the first and second posts. The upright support is substantially perpendicular to the base. At least one support brace connects the base to the upright support. A grooved bottom connects to the base. A plurality of spaced-apart finger bars extend from each said support bar of the upright support so that spaces between adjacent finger bars on each said support bar correspond with grooves formed in the grooved bottom. Each said finger bar is at least partially covered in a protective material and each said finger bar extends along substantially the entire length of the base. The grooves in the grooved bottom and the spaces between adjacent finger bars cooperate to accommodate glass panels and/or glass assemblies.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
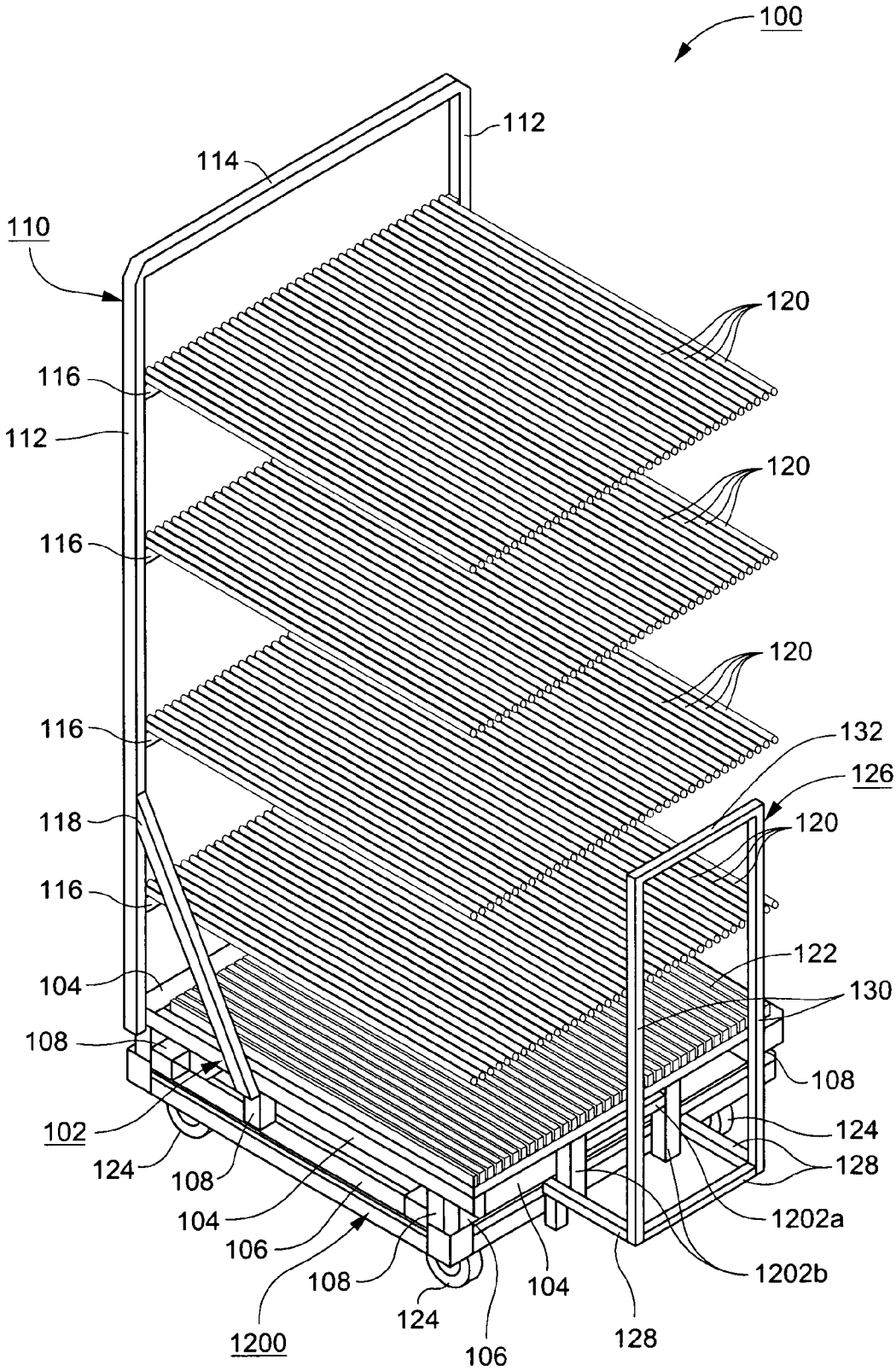
FIG. 1 is a front perspective view of a rack in accordance with an example embodiment.

In certain example embodiments of this invention, an apparatus is provided. A base is provided to the apparatus. An upright support is substantially perpendicular to the base. At least one brace connects the base to the upright support. At least one support bar is provided to the upright support. A grooved bottom is connected to the base. A plurality of spaced-apart finger bars protrude from the at least one support bar so that spaces between adjacent finger bars correspond with grooves formed in the grooved bottom. Each finger bar is at least partially covered in a protective material. The base, the upright support, the at least one support bar, and the plurality of finger bars are metal inclusive and capable of withstanding exposure to autoclaving temperature and pressure conditions. The grooved bottom and the protective material covering the finger bars are capable of withstanding exposure to autoclaving temperature and pressure conditions. The grooved bottom is connected to the base so as to accommodate at least some expansion and/or contraction of the base relative to the grooved bottom. The grooves and the spaces between adjacent finger bars are arranged to accommodate glass panels and/or glass assemblies during autoclaving and/or shipping.

In certain example embodiments, an autoclavable and shippable glass rack is provided. a substantially square pallet base is provided to the rack. A substantially rectangular upright support comprises first and second substantially vertical posts, a plurality of support bars connecting the first and second posts, and an uppermost bar connecting the first and second posts. The upright support is substantially perpendicular to the base. First and second braces connect the base to the upright support. A grooved bottom is connected to the base. A plurality of spaced-apart finger bars protrude from each said support bar of the upright support so that spaces between adjacent finger bars on each said support bar correspond with grooves formed in the grooved bottom. Each said finger bar is at least partially covered in a heat-resistant protective rubber. The base, the upright support, each said support bar, and the plurality of finger bars include steel and are capable of withstanding exposure to autoclaving temperature and pressure conditions. The grooved bottom and the protective rubber covering the finger bars are capable of withstanding exposure to autoclaving temperature and pressure conditions. The grooved bottom is connected to the base so as to accommodate at least some expansion and/or contraction of the base relative to the grooved bottom. The grooves in the grooved bottom and the spaces between adjacent finger bars cooperate to accommodate glass panels and/or glass assemblies during autoclaving and/or shipping. The autoclaving conditions include exposure to a temperature of about 300° F. for a period of about 2.5 hours.

In certain example embodiments, a method of making one or more laminated glass panels is provided. A rack is provided, with the rack comprising: a substantially square metal pallet base and a substantially rectangular metal upright support comprising first and second substantially vertical posts, a plurality of support bars connecting the first and second posts, and an uppermost bar connecting the first and second posts, the upright support being substantially perpendicular to the base; first and second braces connecting the base to the upright support; a grooved bottom connected to the base so as to accommodate at least some expansion and/or contraction of the base relative to the grooved bottom; and a plurality of spaced-apart finger bars protruding from each said support bar of the upright support so that spaces between adjacent finger bars on each said support bar correspond with grooves formed in the grooved bottom, each said finger bar being at least partially covered in a heat-resistant protective rubber. At least one sandwich is created. Each said sandwich corresponds to one said laminated glass panels to be made. Each said sandwich comprises first and second glass panels surrounding a polymer-inclusive laminating layer. Each said sandwich is loaded into the rack such that each sandwich slides along a groove and in between corresponding adjacent finger bars. The rack including the at least one sandwich is autoclaved in making the one or more laminated glass panels. The rack and each component thereof is capable of withstanding temperature and pressure conditions associated with the autoclaving while supporting the sandwiches and/or laminated glass panels.

In certain example embodiments, an apparatus is provided. The apparatus includes a pallet base. An upright support comprises first and second substantially vertical posts. A plurality of support bars connect the first and second posts, and an uppermost bar connects the first and second posts. The upright support is substantially perpendicular to the base. At least one support brace connects the base to the upright support. A grooved bottom connects to the base. A plurality of spaced-apart finger bars extend from each said support bar of the upright support so that spaces between adjacent finger bars on each said support bar correspond with grooves formed in the grooved bottom. Each said finger bar is at least partially covered in a protective material and each said finger bar extends along substantially the entire length of the base. The grooves in the grooved bottom and the spaces between adjacent finger bars cooperate to accommodate glass panels and/or glass assemblies.

Example Rack Design

Figure 2:
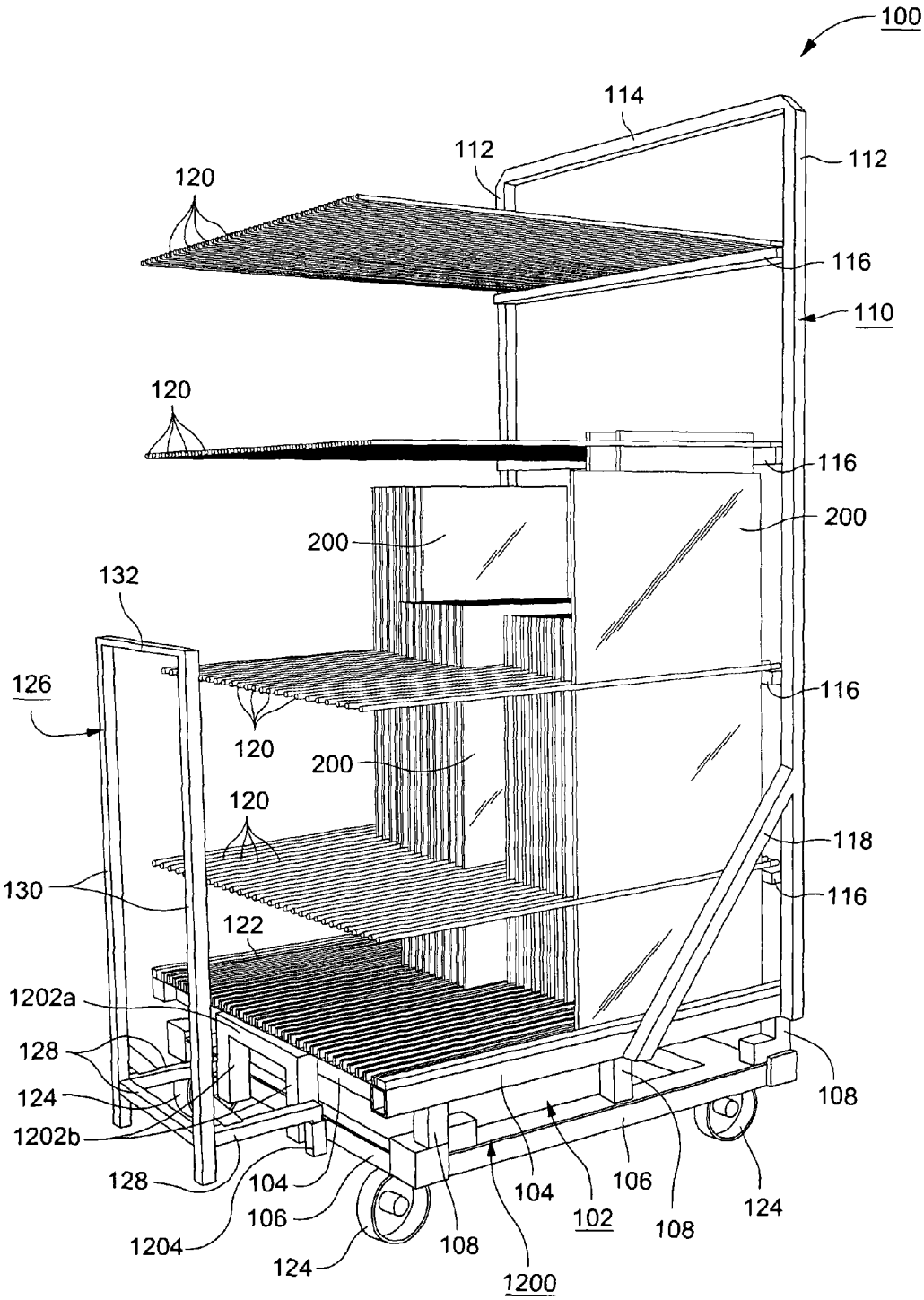
FIG. 2 is a front perspective view of a rack having glass panels loaded therein in accordance with an example embodiment.
Figure 3:
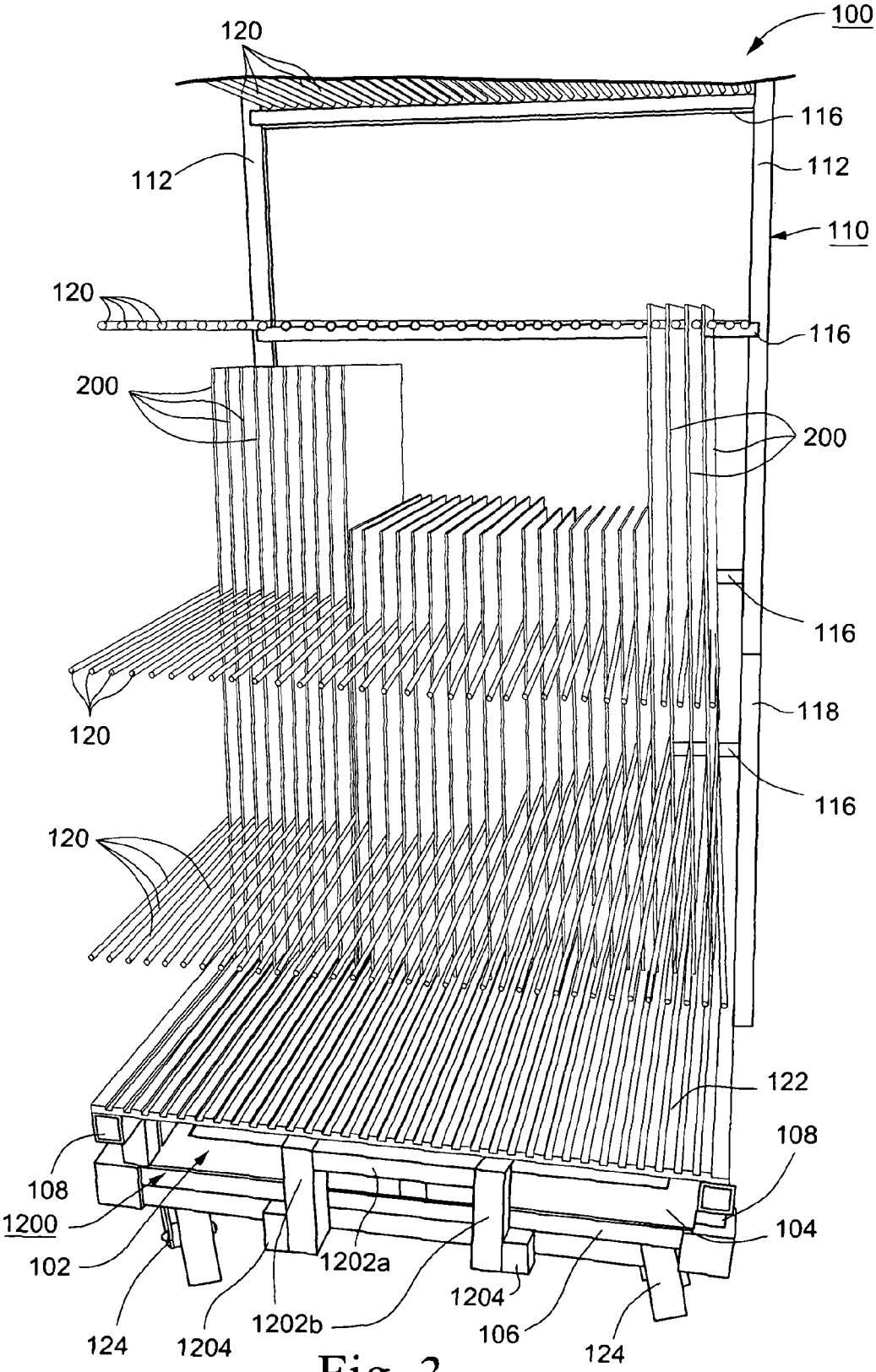
FIG. 3 is a front view of a rack having glass panels loaded therein in accordance with an example embodiment.

Referring now more particularly to the drawings in which like reference numerals indicate like components throughout the several views, FIGS. 1-4*b* help illustrate a rack 100 that is both autoclavable and shippable according to an example embodiments. The rack 100 comprises a base 102 and an upright support 110. The base 102 and the upright support 110 are substantially perpendicular to one another. Support cross-beams or braces 118 located on opposite sides of the rack 100 may connect the base 102 and the upright support 110 so as to increase the stability therebetween. Some or all of these components may be left open at the ends thereof (e.g., as shown in FIGS. 2 and 3 and elsewhere) to allow fast heat-up and cooling of the frame. This arrangement helps reduce the chances of the frame affecting the heating of the glass panels when the rack 100 is in the autoclave. In certain example embodiments, the base 102 and the upright support 110 may be welded together, may be manufactured as or to be an integral with each other, etc.

The base 102 is constructed similar to a conventional pallet known in the shipping and storing arts. Thus, the base 102 may be substantially square shaped. Upper and lower portions of the base 102 may respectively comprise a plurality of upper base beams or tubes 104 and lower base beams or tubes 106, the upper base beams 104 and lower base beams 106 being separated by spacers or blocks 108. The spacers 108 may be located at least at the corners of the base 102. For example, spacers 108 may be about 2"×2"×3" blocks, which may be welded at the corners of the base 102. Placing the spacers 108 at the corners in this and/or other ways may make it easier to securely strap-down the rack 100, e.g., when on a trailer during transport, by enabling straps to be run along the interior of such spacers or blocks 108 in the front, back, and/or sides of the rack 100. This arrangement may facilitate fork lift loading and/or movement of the rack 100. The pallet-like arrangement of the base 102 also may allow one or more racks 100 to be secured during shipment, e.g., by tying the racks 100 together, tethering the racks 100 to fixed points within a vehicle, etc. The design of the base 102 enables the rack 100 to be moved from any side, e.g., by forklifts and/or pallet trucks. Moreover, the rack design allows it to be easily loaded onto open flat bed or closed trailer for transport, as described in greater detail with reference to FIG. 11.

Additionally, the base 102 optionally may include a plurality of wheels 124, which may be located at least at the corners thereof. The wheels 124 may be removably connected to the base 102. In certain example embodiments, the rack may be separate from but loadable onto a dolly base 1200 with wheels 124 (e.g., as shown perhaps best in FIG. 12*a*, which is described in greater detail below). These arrangements may be advantageous in that they may allow for easy movement of the rack 100 during the lamination line assembly process and at the final site, but also allow for the rack 100 to be more stable during the shipping in that the wheels optionally may be removed prior to shipping or in that the rack 100 may be removed from the dolly base 1200 prior to shipping. In either arrangement, the wheels 124 may include locks thereon to reduce the likelihood of undesirable movement.

The upright support 110 includes two spaced apart substantially vertical posts 112. An uppermost bar 114 connects these two posts 112. At least one support bar 116 also spans the two gap between the posts 112. For example, four support bars 116 are shown in the FIG. 1 embodiment. It will be appreciated that more or fewer support bars may be used in certain example embodiments. The number and vertical placement of support bars 116 may be based on, for example, the size dimensions of the panels to be supported by the rack 100. That is, certain example embodiments may accommodate larger panels by providing more support bars 116 provided spaced farther apart. In certain example embodiments, more support bars placed closer together may help support more brittle panels that tend to require additional support.

A plurality of finger bars 120 extend from each of the support bars 116. Panels may be inserted in between adjacent finger bars 120. The finger bars 120 may be formed from the same material as the frame of the rack 100. However, they may be covered with a protective material, such as rubber or the like, so as to reduce the likelihood of damage to the panels stored therebetween. The protective material may be resilient enough so as to survive the harsh conditions (e.g., the temperature and pressure conditions of the autoclave) while also being supportive enough to adequately protect the panels during transit. In certain example embodiments, the protective material may be a rubber tubing providing around the metal fingers. For example, the rubber tubing may include a commercially available (e.g., from McMaster-Carr) heat-resistant rubber such as, for example, ethylene propylene diene monomer rubber (EPDM), Santoprene rubber, and/or the like.

The metal finger bars 120 may be welded to the support bars 116 in certain example embodiments, whereas in certain example embodiments, the metal finger bars 120 may be removably connected to the support bars 116. The same or different protective material may be provided to the surface of the support bars 116 that contacts the panels so that when the panels are slid in between the finger bars 120, they are stopped gently, thereby reducing the chances of damage being done to the panels, e.g., by contacting the metal support bars 116 directly and/or with a large amount of force. As such, stoppers or bumpers in the form of rubber tubing may be applied to each of the support bars 116 (e.g., as shown and described in greater detail below in connection with FIG. 4*b*).

The finger bars 120 may be long. For example, the may span substantially the entire depth of the base 102 in certain example embodiments, although the finger bars 120 do not need to be this long in certain other example embodiments of this invention. The bars 120 covered in the protective material sandwiching a panel, particularly when squeezed, provide a friction hold of the glass. When a rubber material is used for covering the finger bars 120, the "stickiness" of the material advantageously may further help to hold the panels in place. These example features reduce the possibility of the glass moving in substantially any direction, while also providing resilient cushioning. The protective material provided to the finger bars 120 also reduces the chances of the panels being scratched by the finger bars 120, themselves. The frictional hold of the finger bars 120 may be yet further increased when they are tied together, when all of the panels are on the rack and stretch-wrapped together, etc. The metal finger bars 120 (which may be ⅜" metal rods in certain example embodiments) are still somewhat flexible. As such, they hold the panels securely, with the reduced rigidity of the bars allowing for some flexibility and the bars and for some collective movement of the bars and the panels located therebetween. In this configuration, the amount of packaging material required may be reduced (and sometimes even eliminated), thereby saving time and costs. This protection and security feature is advantageous, for example, when the racks are transported on trucks, as it helps to absorb shocks, bumps, vibrations, shakes, and/or other forces.

A grooved bottom 122 may be provided to the base 102 so as to help facilitate sliding the panels into place within the rack. That is, the panels may slide within the grooves formed in the grooved bottom 122. Generally, the grooves in the grooved bottom 122 will correspond with the gaps between the finger bars 120 so that the panels may be lined up with the grooves in the grooved bottom 122 and the gaps between the finger bars 120, and then easily slid along the grooves and between the corresponding finger bars 120. To facilitate the sliding, the grooved bottom 122 may be formed from a heat resistant, non-stick material such as, for example, Teflon. In certain example implementations, the Teflon base is about ¾" thick with about 9⁄16" wide by about 3⁄16" deep slots and about ½" ridges.

The grooved bottom 122 also may be designed to accommodate expansion and contraction of the metal of the rack 100, the grooved bottom 122 itself, the panels 200, etc. Indeed, the inventor of the instant application observed that a steel base expanded much more than a Teflon grooved bottom. A 40" mild steel base moved a total of about ½" relative to the Teflon grooved bottom, or about ¼" movement on either side. This unfortunately caused breakage of the Teflon bottom and compromised the panels stored in the rack. As such, it would be advantageous to allow for the metal in the base 102 to expand while keeping the grooved bottom 122, and the glass racks thereon, substantially in place during the expansion and subsequent contraction. In certain example embodiments, this may be accomplished by connecting the grooved bottom 122 to the base 102 in the following way. The grooved bottom 122 may be bolted to the base 102. The holes for accommodating the screws that secure the grooved bottom 122 to the base 102 may be drilled such that the holes are larger than the shafts of the screws. A double-nut arrangement may be used with each screw to secure the grooved bottom 122 and the base 102. A lock washer may be placed between the two nuts. This arrangement advantageously allows the for the metal in the base 102 to expand while keeping the grooved bottom 122, and the glass racks thereon, substantially in place during the expansion and subsequent contraction.

Figure 14:
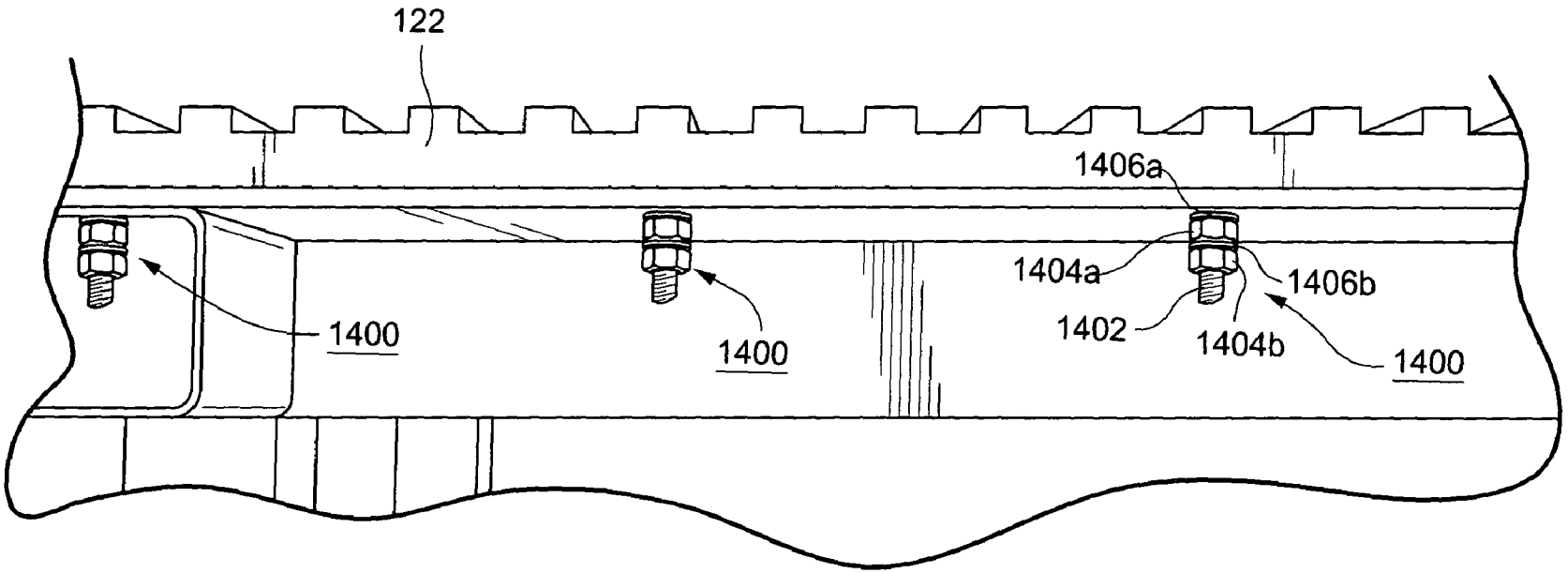
FIG. 14 is a front view of a portion of a glass rack showing how a grooved bottom may be connected to a base of the rack in accordance with an example embodiment.

FIG. 14 is a front view of a portion of a glass rack showing how a grooved bottom may be connected to a base of the rack in accordance with an example embodiment. In certain example implementations, the grooved bottom 122 may be bolted to the metal base in four rows from front-to-back and at approximately every fifth ridge across the rack. As shown in FIG. 14, the connection 1400 includes a bolt 1402 that is fed through a hole in the grooved bottom 122 and holes formed in the base, which may, but need not, be positioned in the same places and/or numbers as described above. The bolt is secured with an optional first washer 1406*a* closest to the grooved bottom 122, a first nut 1404*a*, a second washer 1406*b*, and a second nut 1404*b* farthest from the grooved bottom 122.

Figure 12A:
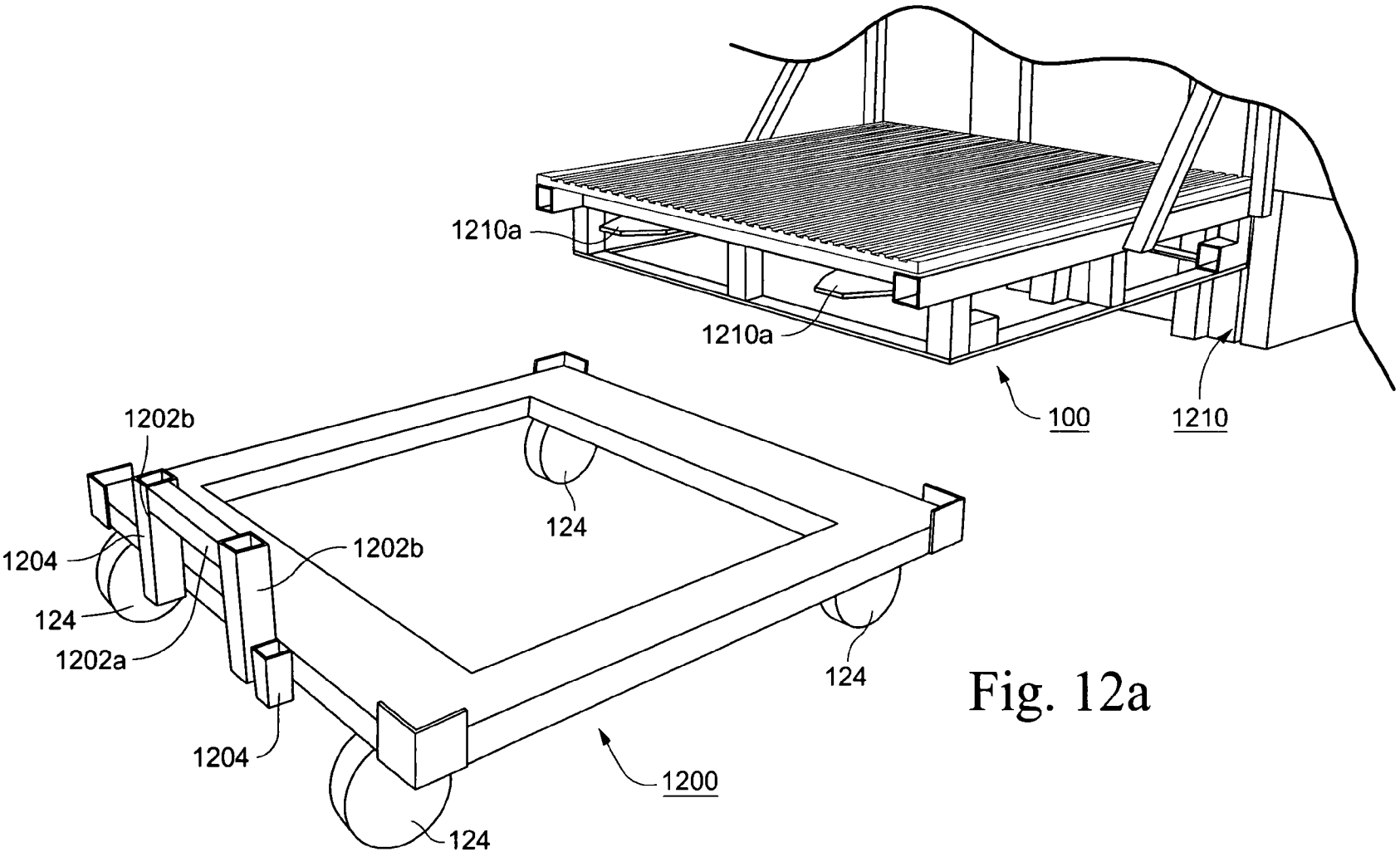
FIG. 12*a* illustrates how a glass rack may be placed on a dolly and/or moved with a forklift in accordance with an example embodiment.
Figure 12B:
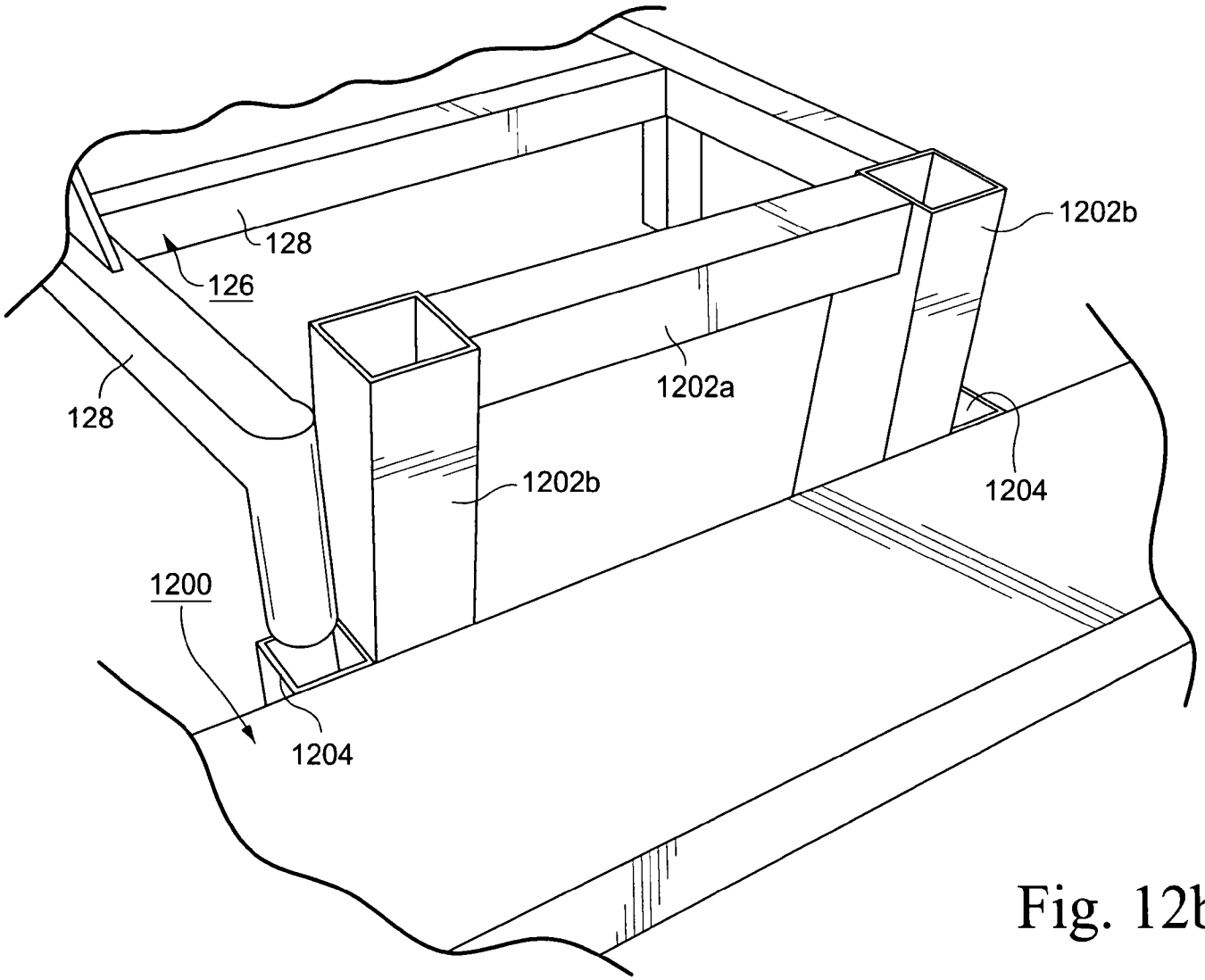
FIG. 12*b* is an enlarged view of a handle bar assembly being inserted into a dolly base in accordance with an example embodiment.
Figure 12C:
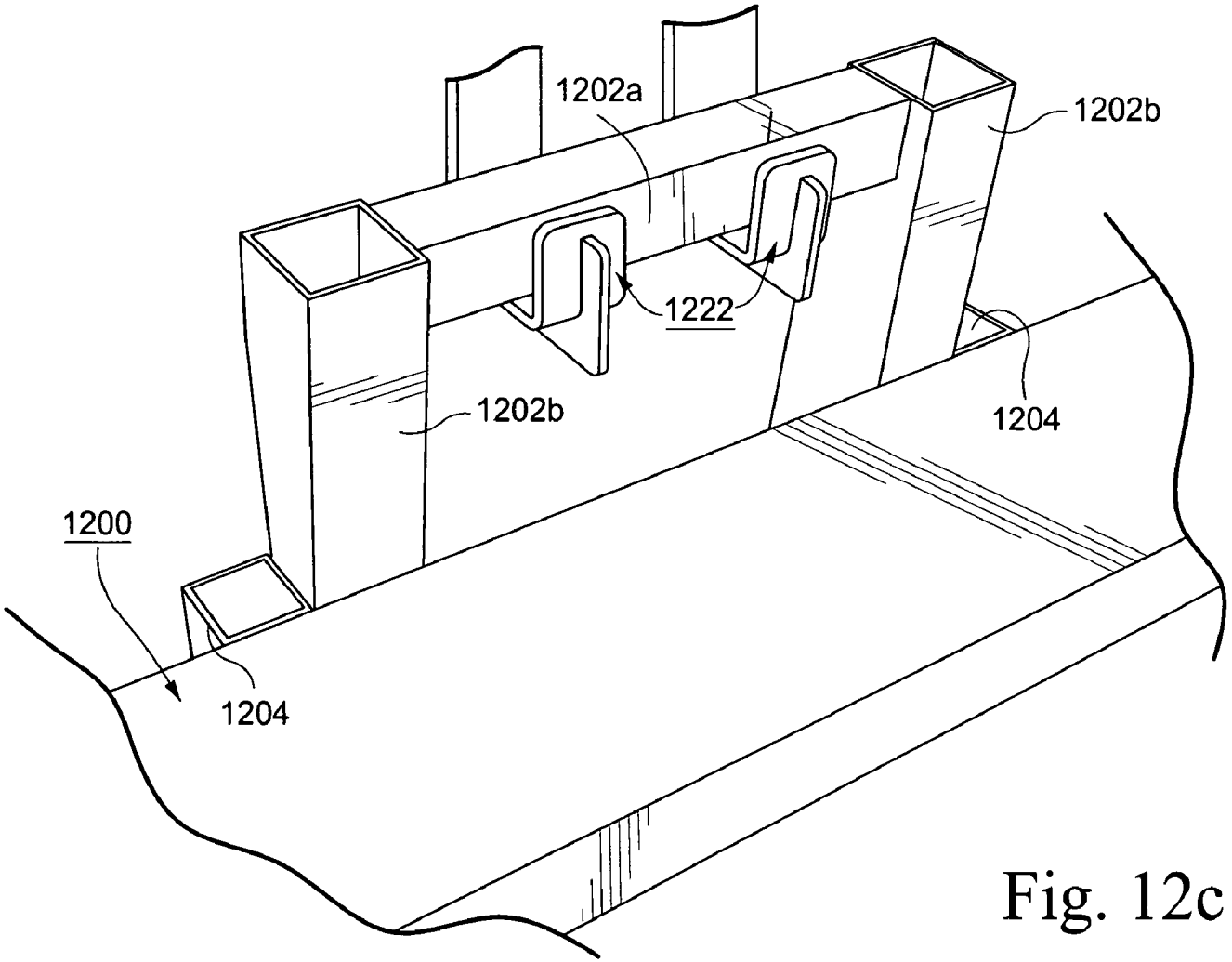
FIG. 12*c* illustrates how a glass rack on a dolly may be moved using a power mover in accordance with an example embodiment.

The rack 100 may be moved using its upright support 110. In certain example embodiments, a handle bar assembly 126 also optionally may be provided to facilitate movement of the rack 100. The handle bar assembly 126 may be substantially L-shaped when viewed in cross section. Thus, it may include a base pieces 128 that connect with upright pieces 130 that are substantially perpendicular thereto. A handle bar 132 may connect the upright pieces 130 so as to facilitate movement of the entire rack 100. The handle bar assembly 126 may be removably connected to the dolly base 1200 or the rack 100 so as to allow panels to be loaded into the rack more easily. In this vein, the base pieces 128 may slide into the square tubing or receiving channels 1204 provided in the dolly base 1200 or grooves or holes provided in the base 102 of the rack 100, may be secured to the dolly base 1200 or base 102 using a pin-type connection, etc. For example, the handle bar assembly 126 may slide into receiving channels 1204 of a dolly base 1200 as shown in FIGS. 12*a*-12*c*, for example. The handle bar assembly 126 may be located on the rack 100 opposite the upright support 110. As will be described in greater detail below, the handle bar assembly 126 may be advantageous, for example, because of the ways in which racks are loaded into autoclaves, vehicles, etc. In short, it may sometimes be difficult to load racks 100 into autoclaves for autoclaving and/or vehicles for shipping using only the upright support 110.

FIGS. 2 and 3 show how panels 200 may be slid along the grooved bottom 122 and through the fingers 120. The racks certain example embodiments may be capable of accommodating a wide variety of sizes and shapes of panels. Indeed, as can be appreciated from FIGS. 2 and 3, the panels 200 may be differently sized and/or shaped. Numbers or other identifiers may be provided along the grooved bottom 122 or in another location in certain example embodiments to help identify the particular panels 200 loaded in the rack, especially when many differently sized, shaped, or otherwise intended products may be loaded on a single rack. The finger bar design allows any panel to be remove and replaced independently without affecting any of the other panels.

Figure 4A:
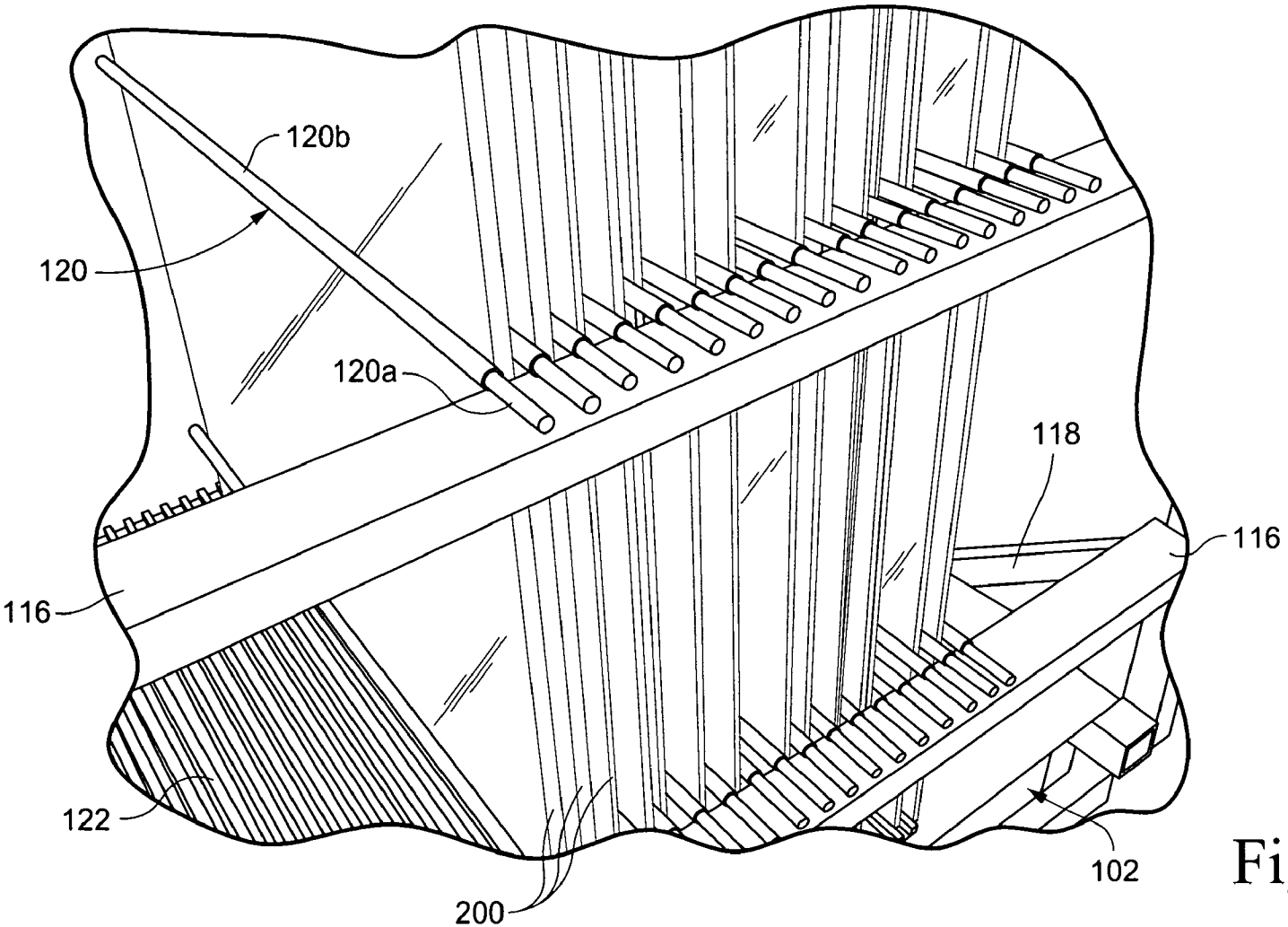
FIG. 4*a* is a partial rear perspective view of a rack having glass panels loaded therein in accordance with an example embodiment.

FIG. 4*a* is a partial rear perspective view of a rack having glass panels loaded therein in accordance with an example embodiment. FIG. 4*a* helps to demonstrate how the finger bars 120 and the grooved bottom 122 cooperate to hold the panels 200 in place. FIG. 4*a* also shows how the metal finger bars 120*a* may be covered with the protective material 120*b* at substantially all of the portions where the panels 200 may come into contact with the finger bars 120. In the example embodiment shown in FIG. 4*a*, the metal finger bars 120 are welded to the support bar 116. However, the finger bars 120 may be removably connected to the support bar 116 in certain example embodiments. For example, in certain example embodiments, receiving channels or recesses may be formed along the support bar 116, and at least the exposed metal portion 120*a* of the fingers 120 may be inserted therein. In this and/or other ways, the number and placement of finger bars 120 may be varied in accordance with the particular needs at any given time. Although the finger bars 120 of certain example embodiments may be substantially cylindrical, the present invention is not so limited. Thus, in certain example embodiments, differently shaped finger bars may be implemented such as, for example, finger bars that appear to be substantially rectangular, triangular, diamond-shaped, oval-shaped, etc. This may be advantageous, for example, when single lites and/or insulated glass (IG) units are to be loaded onto a rack.

Figure 4B:
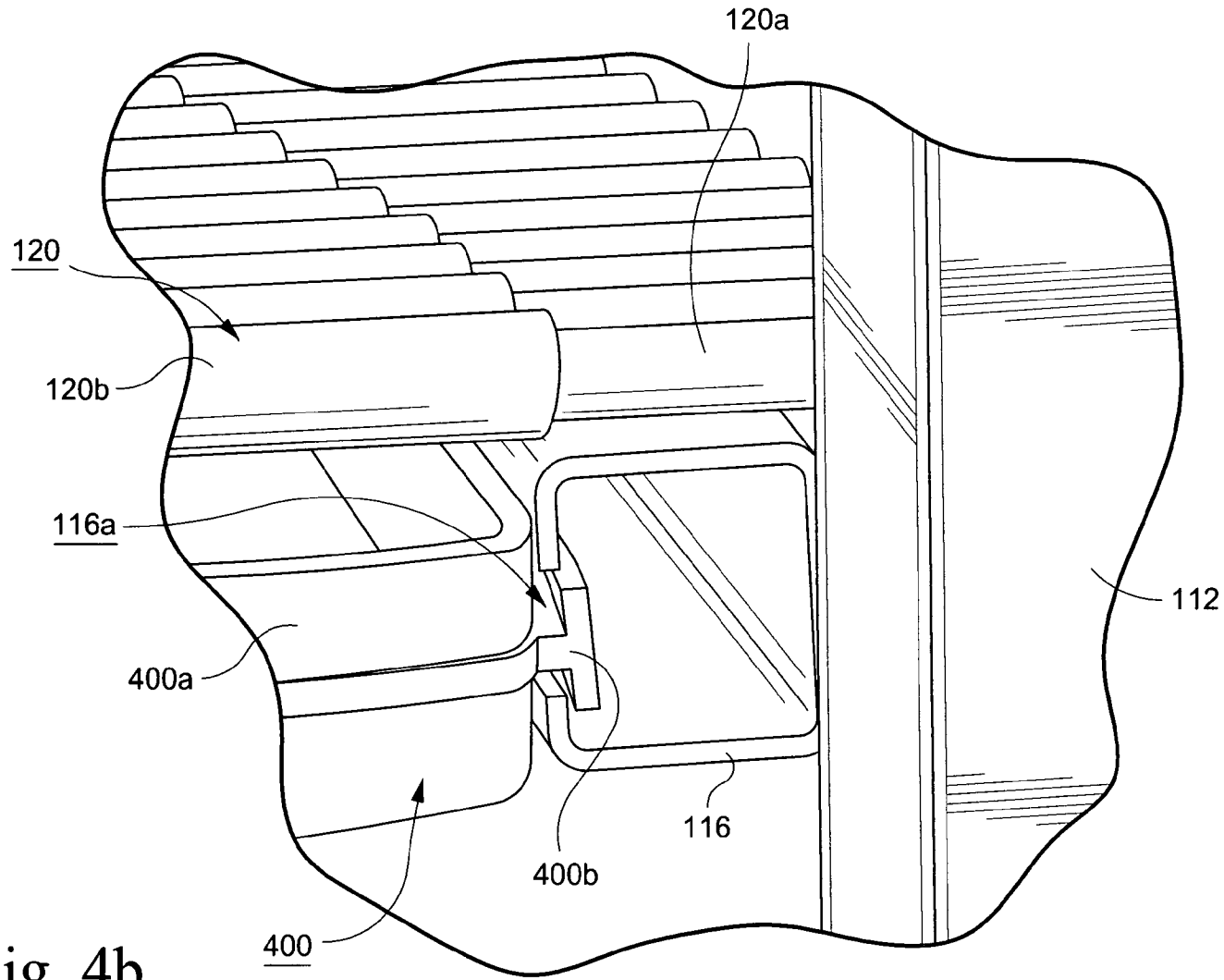
FIG. 4*b* is a partial side perspective view of a rack showing how a rubber backing or stopper may be connected to a support bar in accordance with an example embodiment.

FIG. 4*b* is a partial side perspective view of a rack showing how a rubber backing or stopper may be connected to a support bar in accordance with an example embodiment. The rubber stoppers 400 provided to the support bars 116 have a substantially T- or H-shaped profile. For example, as shown in FIG. 4*b*, the rubber stopper 400 includes a main body 400*a* with a T-shaped protrusion 400*b* that protrudes from the back thereof. This T-shaped protrusion 400*b* of the rubber stopper 400 may fit into an opening 116*a* formed in the support bar 116. Alternatively, or in addition, the rubber stoppers 400 may be connected to the support bars 116 in some other way. In certain example embodiments, then, the support bar 116 may be a 1-¼" gap tube, with the gap being capable of receiving the substantially T- or H-shaped protrusion that protrudes from the rubber stopper 400.

Figure 5:
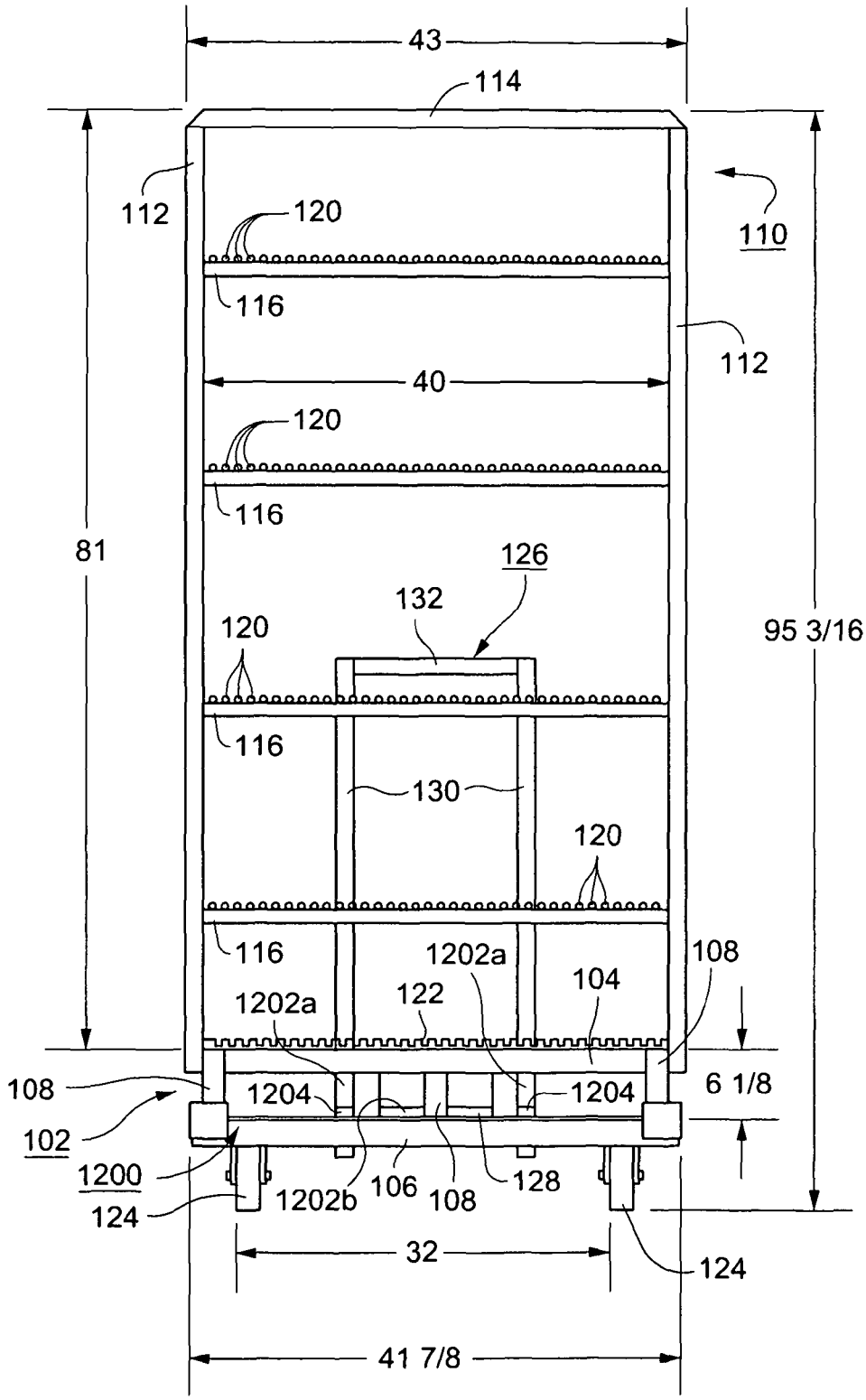
FIG. 5 is a rear plan view of a rack showing illustrative dimensions thereof in accordance with an example embodiment.
Figure 6:
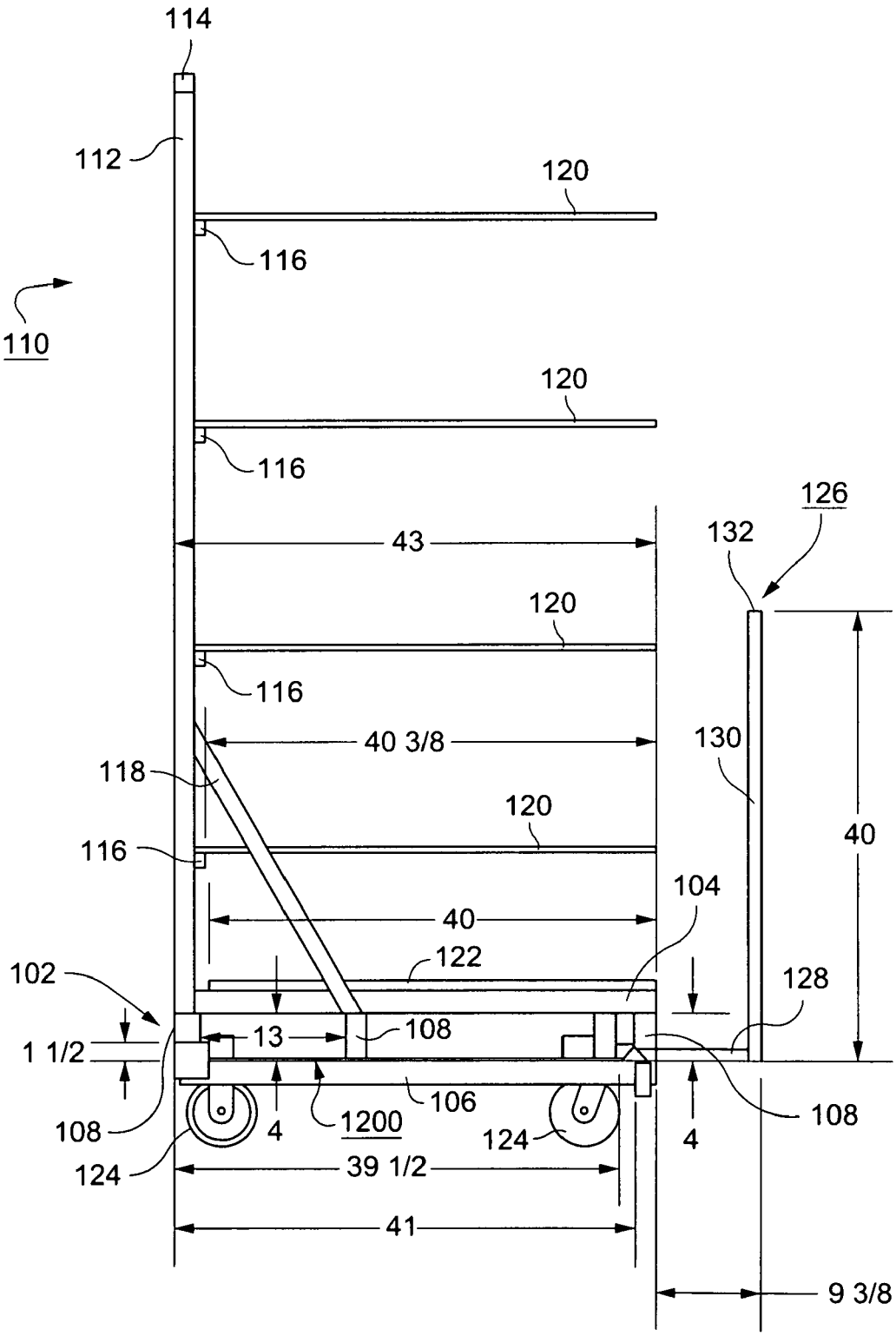
FIG. 6 is a side plan view of a rack showing illustrative dimensions thereof in accordance with an example embodiment.

FIG. 5 is a rear plan view of a rack showing illustrative dimensions thereof in accordance with an example embodiment, and FIG. 6 is a side plan view of a rack showing illustrative dimensions thereof in accordance with an example embodiment. It will be appreciated that the dimensions provided in FIGS. 5 and 6 are provided by way of example and without limitation. As alluded to above, the number and locations of the support bars 116 and finger bars 120 may be varied, as may the overall dimensions of the rack 100.

The metal used in the frame of the rack 100 and in the fingers 120 may be a mild steel. The metal used in the frame of the rack 100 and in the fingers 120, the protective material used over the fingers 120, the material of the grooved bottom 122, and/or other elements provided on the rack 100 may be capable of withstanding the conditions of the autoclave. This includes, for example, exposure to temperatures of at least about 300° F. for at least about 2.5 hours. Indeed, the durable high temperature rubber covered metal finger bars may withstand repeated temperature cycles to 300° F. in the autoclave, as well as protect the panels from damage/breaking during circulated air-induced vibration, which is considerable in the autoclave, and shaking/vibration during shipping. The configuration of the finger bars also provides protection against damage during shipping and simplifies packing and reduces packing time. The finger bar design allows unrestricted air flow between the panels and reduces the amount of heat distortion on the panels while in the autoclave heat up-cool down cycles.

The inventor of the instant application has observed that most commercial glass panels are from about 10" to about 80" along the major axis thereof. To this end, the designs shown in FIGS. 5 and 6 are capable of accommodating glass panels up to about 40"×80" and at least about 12" along one axis. Furthermore, the inventor of the instant application has analyzed the dimensions and quantities of shipments and has determined that most glass panels will be adequately protected by including, for example, four levels of support bars 116 at 12", 30", 50" and 68" from the grooved bottom 122. However, the present invention is not limited to these or any particular arrangements. Additionally, it has been determined that 34 slots defined by 35 bars at each of the four levels is advantageous in terms of typical autoclaving and shipping requirements, with such finger bars 120 having a center-to-center spacing of about 1.125", thereby supporting panels less than or equal to about 9/16" thick. The finger bar design also may be adapted to other rack designs for larger panels.

Figure 7:
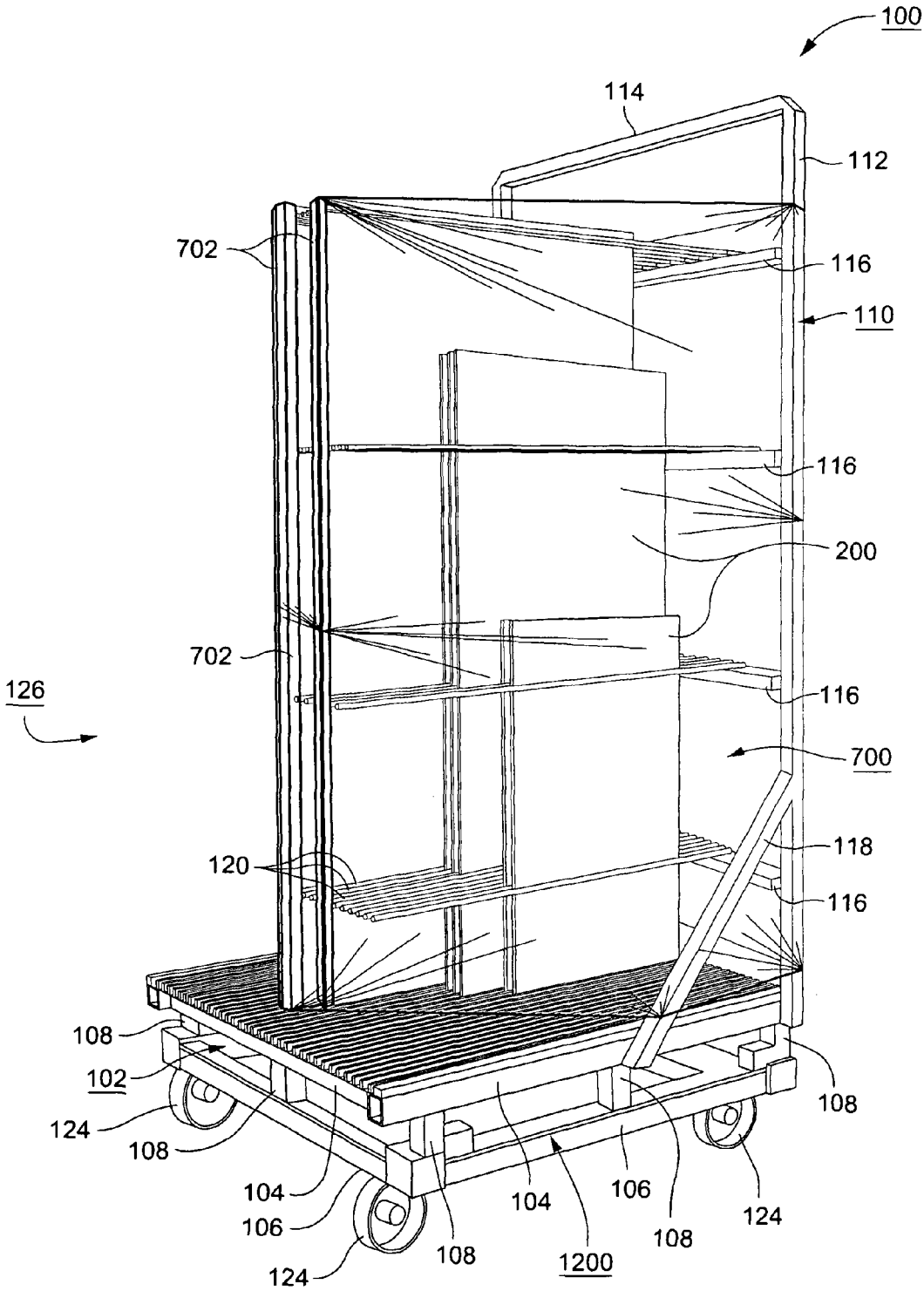
FIG. 7 is a front perspective view of a packaged rack in accordance with an example embodiment.
Figure 8:
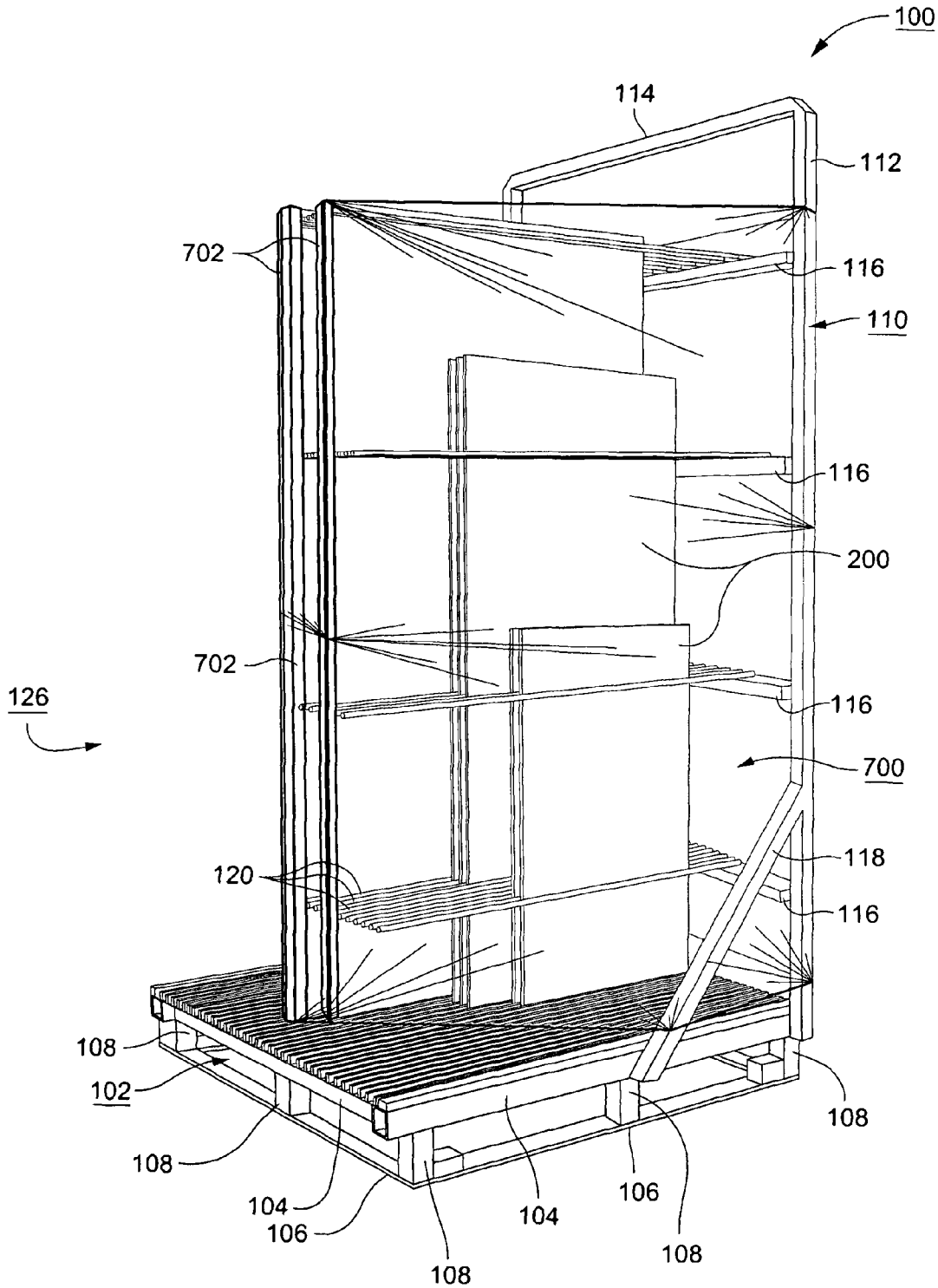
FIG. 8 is a side view of a packaged rack in accordance with an example embodiment.

The design of the rack 100 allows the panels to be easily stretch wrapped, cutting packaging time by four times or more in certain example embodiments. FIGS. 7 and 8 show packaged racks in accordance with an example embodiment. In both FIGS. 7 and 8, the rack is wrapped with a wrapper 700 for shipping. This helps to reduce the chance of debris contacting and/or damaging the panels 200. It also helps to hold the panels in place. In certain example embodiments, the wrapper 700 may be a plastic wrapper. Sometimes, the corners of the glass panels 200 are exposed. This may cut the wrapper 700. Accordingly, as shown in FIGS. 7 and 8, upright posts or corners 702 (e.g., cardboard corners) are provided so as to reduce the amount of direct contact between the glass panels 200 and the wrapper 700. Additionally, or in the alternative, certain example embodiments may include a thicker plastic tape that is stronger and more resistant to cutting so that the need for corners 702 is reduced or even eliminated. Such heavy-duty tape may be provided along the edges and/or corners of the glass panels 200. One non-limiting example of such a heavy-duty tape is "No Residue Orange Tape" commercially available from Marcy Adhesives, which is made for the glass industry, Thus, certain example embodiments advantageously may reduce the need for triple or quadruple handing and repacking of the laminated glass panels once they are off of the lamination line. Packaging and shipping time may be by 75% or more. Additionally, the amount of damage to panels, and the number of panels lost, may be reduced, thereby reducing the need for additional work caused by the lamination line process itself. As will be appreciated from the above description, the fabrication costs of the rack design of certain example embodiments is reasonable, and the fabrication process itself is easy and straightforward.

Figure 9A:
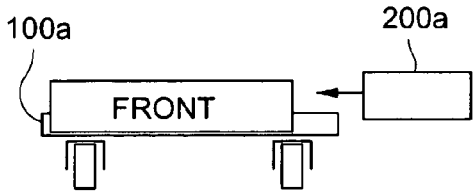
FIGS. 9*a* and 9*b* respectively illustrate how products may be loaded in left-hand and right-hand side configurations in accordance with an example embodiment.
Figure 9B:
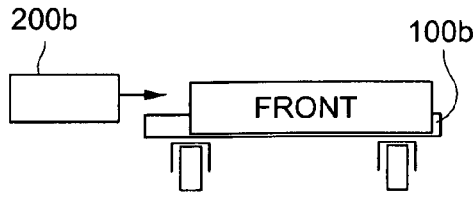

The racks of certain example embodiments may be loaded directly from the manufacturing process onto transports. Once loaded, off-loading may be facilitated by pump truck, fork lifts, etc. The racks may be provided with wheels or castors, to promote mobility within a facility and/or at end-use production. Example Rack Process Flows FIGS. 9*a*-11 help demonstrate process flows that may be used in connection with the racks. FIGS. 9*a* and 9*b* respectively illustrate how products may be loaded in left-hand and right-hand side configurations in accordance with an example embodiment.

The following procedure may be used when loading panels onto a rack. Before using the rack, the rack, including the bars and base may be cleaned to reduce contamination of the panels. For example, the rubber bars and base may be blown off with compressed air and/or wiped with a damp cloth or brush as needed. To reduce the interference of the racks in the middle of the autoclave, panels 200*a* may be positioned to sit on the right-hand side (RHS) of carts 100*a* for racks going on right-hand side of the autoclave 1000, whereas panels 200*b* may be positioned to sit on the left-hand side (LHS) of carts 100*b* going on the left-hand side of the autoclave 100. Arrows may be provided on the rack (e.g., on the top of the back of the rack) to decide which side of the autoclave the racks should be loaded.

Panels may be loaded into the racks in a predetermined order (e.g., from left-to-right). Numbers may be provided near the grooves or slots on grooved base to help position the panels. The panels may be pushed all the way to the back of the rack, along through grooves and between adjacent fingers, until they touch the rubber stop located on the support arms.

In general, if a panel may be inserted with either vertically or horizontally, inserting the panel horizontally advantageous may reduce the chances of it falling over. For tall, narrow panels, hi-temp tubing may be used to tie the panels to the upright support and/or support bars of the rack to help ensure that they do not tip over. In typical scenarios, once the panels are loaded into the rack, they do not need to be secured in any other way. The handle bar assembly or a power mover may be used to move the rack.

Figure 10:
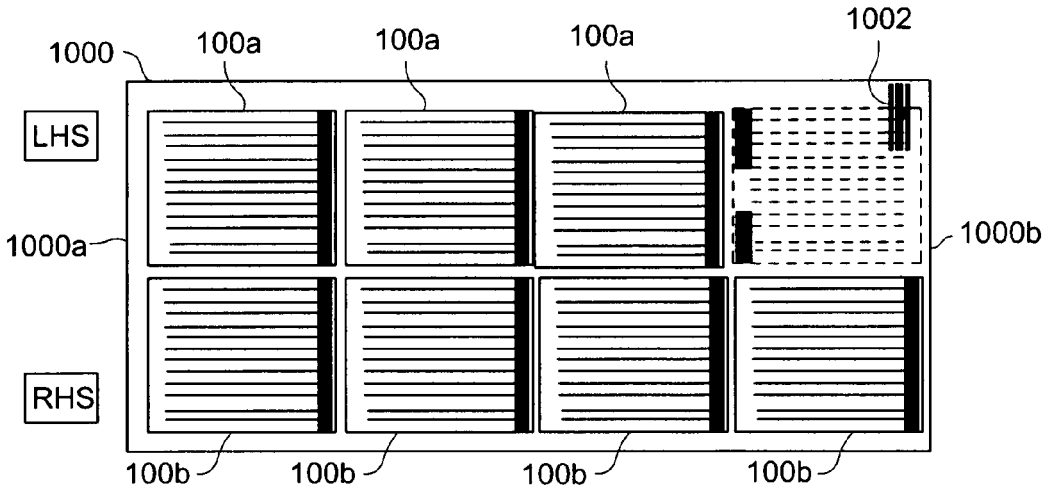
FIG. 10 illustrates how a plurality of racks may be loaded into an autoclave for autoclaving in accordance with an example embodiment.

FIG. 10 illustrates how a plurality of racks 100 may be loaded into an autoclave 1000 for autoclaving in accordance with an example embodiment. In typical autoclave designs, four racks 100*b* can be loaded into the right-hand side of the autoclave 1000 with the rack backs towards the back of the autoclave 1000. However, only three racks 100*a* can be loaded into the left-hand side of the autoclave 1000 with the rack backs towards the back of the autoclave 1000, as there is a pipe 1002 that interferes on the lower left side at the back. On the left-hand side, if panels do not interfere with the pipe 1002 in the back of the autoclave 1000, a fourth rack 100*b* may be loaded in first with the rack front towards the back. However, the panels on the rack 100*b* may have to be tied back at two levels with hi-temp tubing to reduce the chances of them moving out of the rubber covered bars.

The air flow inside the autoclave 1000 typically is from front-to-back in the middle of the autoclave at about 10-30 km/hr (10-30 ft/sec) estimated. This air speed is strong enough to move lites on the racks. To reduce interference caused by or with the racks in the middle of the autoclave, it is advantageous to ensure that racks going on the RHS sit to RHS of the rack, while racks going on the LHS sit to LHS of the rack. Arrows on the rack may be used to indicate the better side of the autoclave 1000 to load the racks. Three racks per side generally can fit on the autoclave lift. If four racks per side are loaded, it may be advantageous to load two racks per side at a time on the lift. When loading the racks into the autoclave 1000, one rack each may be loaded on the RHS and LHS, to ensure that they fit in without interference. When all racks are loaded, the wheels of the racks at the front of the autoclave 1000 may be chocked to attempt to keep them from rolling forward during autoclaving.

After autoclaving, the door may be opened slowly so that it is possible to ensure that no racks roll out of the autoclave 1000. The racks may be removed, one rack at a time, from the RHS and LHS of the autoclave 1000.

A description of how panels and racks may be packaged for shipping according to certain example embodiments will now be provided. Each panel may be pulled out and inspected. The panels may be cleaned, if necessary, and reloaded onto the rack in the same numbered slot. Bar codes indicative of the order may be scanned to verify order completion. A sheet containing the bar codes may be inserted into a shipping envelope and later attached the outside of the stretch wrap. A length of foam of about 3"-5" is inserted between each panel at the back of the rack at one or more level, as needed. Tape may be used to cover the edges that may come into contact with the stretch wrap, and/or cardboard corners may be used to protect the stretch wrap from the sharp edges of the panels.

The panels on each rack may be examined to determine how the panels might shift or fall over during shipping, and then a determination as to how best to reduce any damage may be made. When this assessment is completed, stretch wrapping may be used to hold all of the panels on the rack as one solid piece with very little or no movement. For example, for narrower panels in the middle that might tip over or shift during shipping, these bars may be wrapped first and together as close to the panels as possible. Alternatively, or in addition, they may be stretch wrapped together to the rack back support. The ends of all bars at one level may be stretch wrapped together to ensure that panels will not work their way out.

Stretch wrapping, in general, may involve first tying off the stretch wrap at the bottom of the rack back support. The lower level may be wrapped, working upwards to the highest level, while ensuring that the wrap goes around the rack back before going up to the next level. The panels may be enclosed as much as possible to reduce the panels' exposure to debris, dirt, etc., during shipping.

Figure 11:
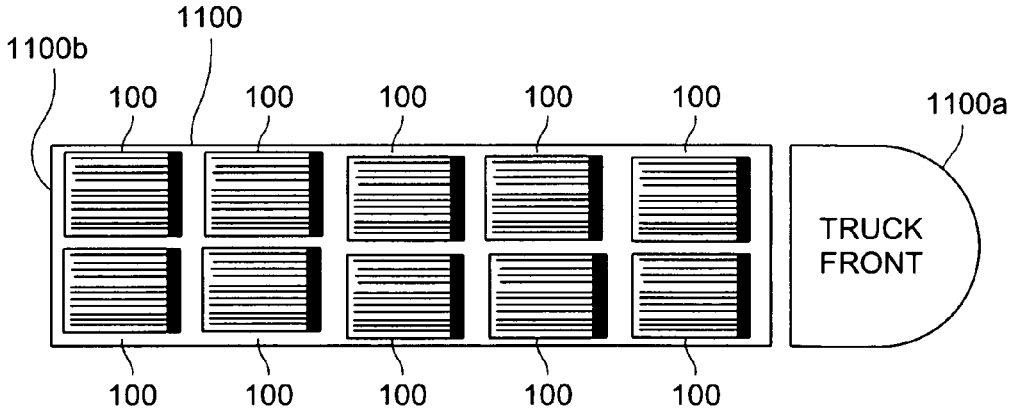
FIG. 11 illustrates how a plurality of racks may be loaded into a truck or other vehicle for shipping in accordance with an example embodiment.

FIG. 11 illustrates how a plurality of racks may be loaded into a truck or other vehicle for shipping in accordance with an example embodiment. Racks may be loaded side-by-side onto a trailer, with the rack backs towards the front of the trailer so that the panels are substantially inline or parallel with the direction of travel. Straps may be run through the rack feet or base at the front and the back to help secure the racks in place. The straps also may be wrapped around the outer legs to reduce side-to-side movement.

FIG. 12*a* illustrates how a glass rack may be placed on a dolly and/or moved with a forklift in accordance with an example embodiment. As noted above, in certain example embodiments, the rack 100 may be separate from and loaded onto a dolly base 1200 with wheels 124. The dolly base 1200 may facilitate the loading of racks 100 into autoclaves. A rack 100 may fit into or within rails or corners of the dolly 1200. The two front wheels 124 of the dolly may be castors, whereas the two rear wheels may be fixed, in certain example embodiments. As shown in FIG. 12*a*, the rack 100 may be moved via a forklift 1210. The arms 1210*a* of the forklift may fit into the pallet base 102 of the rack 100 to facilitate movement from any side of the rack 100. As such, the rack 100 may be used with or without a forklift, and it may be shipped with or without a dolly base.

FIG. 12*b* is an enlarged view of a handle bar assembly 126 being inserted into a dolly base 1200 in accordance with an example embodiment. As shown in FIG. 12*b*, the legs of the handle bar assembly 126 may be inserted into receiving channels 1204 of the dolly base 1200. As shown in FIG. 12*b*, the receiving channels 1204 are located on opposing sides of the top bar 1202*a* of the dolly base 1200.

FIG. 12*c* illustrates how a glass rack on a dolly may be moved using a power mover in accordance with an example embodiment. A power mover may include hooked arms 1222, which may grab onto the top bar 1202*a* of the dolly base 1200, with the top bar 1202*a* being supported by two side bars 1202*b*, for example. As such, it will be appreciated that the rack 100 of certain example embodiments may be movable manually, or by forklift, power movers, or other means.

Figure 13:
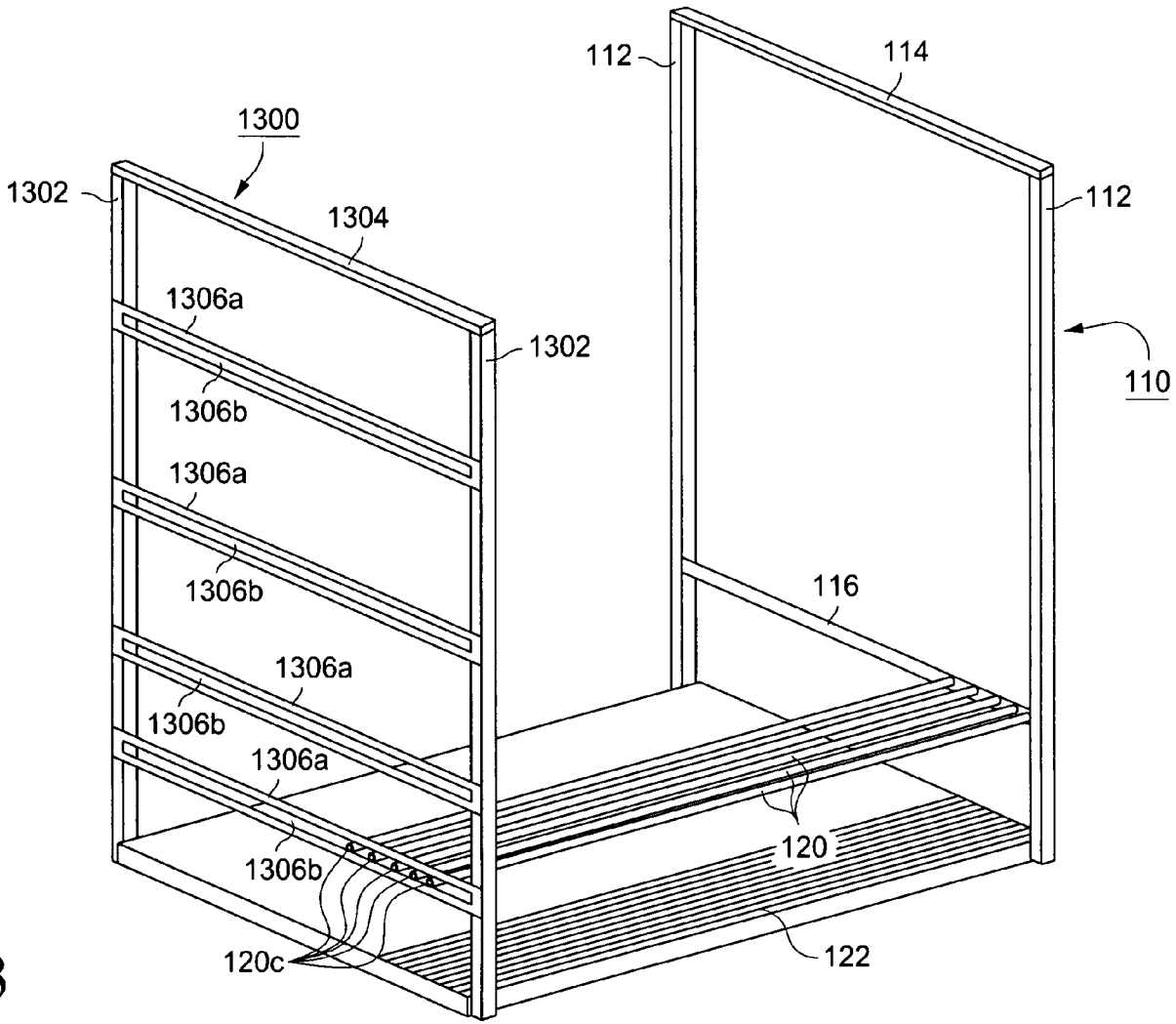
FIG. 13 shows an example glass rack including an additional vertical support in accordance with an example embodiment.

FIG. 13 shows an example glass rack including an additional vertical support 1300 in accordance with an example embodiment. The additional vertical support 1300 is removably connected to the rack 100 opposite the upright support 110. Similar to the upright support 110, the additional vertical support 1300 may include two substantially vertical bars 1302 and an uppermost support bar 1304. A plurality of finger bar holders 1306*a* may be provided. Each of the finger bar holders 1306*a* may include one or more gaps or holes 1306*b*. These gaps or holes 1306*b* may allow at least the end portions 120*c* (e.g., the last few millimeters or centimeters) of the finger bars 120 to slip or fit into the finger bar holders 1306*a*. This arrangement may help to hold and squeeze the finger bars 120 against the panels to secure them for transport, with the amount of packaging and/or stretch wrapping being reduced (and sometimes even eliminated).

Although the example embodiments herein have been shown and described as having substantially perpendicular bases and upright supports with the base being substantially parallel to the ground, the present invention is not so limited. Thus, the rack may be titled or angled in certain example embodiments. For example, the rack may be titled from front-to-back at an angle of 5° in certain example implementations, e.g., such that the front of the rack is slightly elevated when compared to the back of the rack. Tilting or angling racks in these and/or other ways advantageously may help to reduce longitudinal glass movement. The tilting or angling may be accomplished in certain example embodiments by, for example, welding spaces under the front of the rack base.

It will be appreciated that although certain example embodiments have been described with reference to laminated glass panels and/or assemblies, the present invention is not so limited. For example, certain example embodiments of this invention may be suitable for use with any type(s) of glass panels, assemblies, and/or intermediate products, such as, for example, laminated glass panels, single lites, insulated glass (IG) units, vacuum insulated glass (VIG) units, and/or the like. Thus, certain example embodiments of this invention may be used in connection with any single or multiple glass lite that has been, or is being, assembled.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An apparatus for holding glass, comprising:

a base;

an upright support comprising first and second substantially vertical posts, a plurality of support bars connecting the first and second posts, and an uppermost bar connecting the first and second posts, the substantially vertical posts of the upright support being substantially perpendicular to the base;

a grooved bottom supported by at least the base; and a plurality of spaced-apart finger bars extending from each of the support bars so that spaces between adjacent finger bars correspond with grooves formed in the grooved bottom, the finger bars each having a free distal end, each said finger bar being at least partially covered with a protective material, the finger bars aligned substantially parallel to the base and each said finger bar extending in a substantially same direction over substantially the entire length of the base, wherein the base, the upright support, the plurality of support bars, and the plurality of finger bars are metal inclusive and capable of withstanding exposure to autoclaving temperature and pressure conditions, wherein the grooved bottom and the protective material covering the finger bars are capable of withstanding exposure to autoclaving temperature and pressure conditions, wherein the grooved bottom is supported by the base so as to accommodate at least some expansion and/or contraction of the base relative to the grooved bottom, and wherein the grooves and the spaces between adjacent finger bars are arranged to accommodate glass panels and/or glass assemblies during autoclaving and/or shipping so that the glass panels and/or glass assemblies are to be oriented in the apparatus in a direction substantially parallel to the finger bars.

2. The apparatus of claim 1, wherein the protective material comprises heat resistant rubber tubing, the heat resistant rubber tubing at least partially covering each said metal finger bar.

3. The apparatus of claim 1, wherein the plurality of support bars are at least partially covered in a protective material.

4. The apparatus of claim 1, wherein the grooved bottom is formed from Teflon.

5. The apparatus of claim 1, wherein the grooved bottom is secured to the base via a plurality of screws and nuts, each said screw being fed through a respective hole drilled in the base and being secured by two nuts and a washer placed between the two nuts, each hole being drilled so as to be bigger than the respective screw shaft.

6. The apparatus of claim 1, wherein the metal is a mild steel.

7. The apparatus of claim 1, wherein the base is a pallet.

8. The apparatus of claim 1, further comprising a plurality of wheels provided to the base.

9. The apparatus of claim 1, further comprising a handle bar assembly removably connected to the apparatus opposite the upright support.

10. The apparatus of claim 1, wherein the plurality of support bars further comprise four support bars.

11. The apparatus of claim 1, wherein the autoclaving conditions include exposure to a temperature of about 300° F. for a period of about 2.5 hours.

12. The apparatus of claim 1, wherein the base comprises first and second upper elongated members extending in at least a direction substantially perpendicular to the finger bars, and the base further comprises first and second lower elongated members extending in a direction substantially parallel to the finger bars, wherein the upper elongated members are at an elevation above the lower elongated members.

13. The apparatus of claim 12, further comprises spacers provided between the upper elongated members and the lower elongated members.

* * * * *